US008316817B2

(12) United States Patent
Rücker et al.

(10) Patent No.: US 8,316,817 B2
(45) Date of Patent: Nov. 27, 2012

(54) ROTARY PISTON ENGINE

(75) Inventors: Hans-Gerd Rücker, Esoh-sur-Alzette (LU); Rainer Guder, Bochum (DE); Ralf Georg Lipiensky, Gelsenkirchen (DE); Manfred Thönessen, Bochum (DE)

(73) Assignee: Dezmotec AG, Luxembourg (LU)

( * ) Notice: Subject to any disclaimer, the term of this patent is extended or adjusted under 35 U.S.C. 154(b) by 921 days.

(21) Appl. No.: 12/158,860

(22) PCT Filed: Dec. 21, 2005

(86) PCT No.: PCT/EP2005/057063

§ 371 (c)(1),
(2), (4) Date: Mar. 19, 2009

(87) PCT Pub. No.: WO2007/079766

PCT Pub. Date: Jul. 19, 2007

(65) Prior Publication Data

US 2009/0266316 A1 Oct. 29, 2009

(51) Int. Cl.

| | |
|---|---|
| ***F02B 53/08*** | (2006.01) |
| ***F02B 53/04*** | (2006.01) |
| ***F02B 57/06*** | (2006.01) |
| ***F01B 13/04*** | (2006.01) |
| ***F01B 13/06*** | (2006.01) |

(52) U.S. Cl. ..... 123/212; 123/228; 123/18 R; 123/18 A; 123/44 B; 123/44 R; 123/44 C; 123/43 B; 123/43 C; 123/44 D; 123/44 E

(58) Field of Classification Search ..... 123/212, 123/228, 18 R, 18 A, 43 R, 44 B, 44 C, 44 D, 123/44 E, 44 R, 43 B, 43 C, 43 A, 43 AA
See application file for complete search history.

(56) References Cited

U.S. PATENT DOCUMENTS

| | | | | |
|---|---|---|---|---|
| 897,260 | A * | 8/1908 | Luther | 123/44 D |
| 1,853,563 | A * | 4/1932 | Hungerford et al. | 123/44 E |
| 3,931,810 | A * | 1/1976 | McGathey | 123/44 E |
| 4,072,132 | A * | 2/1978 | Lindros | 123/43 R |
| 4,653,438 | A * | 3/1987 | Russell | 123/44 B |
| 5,211,138 | A * | 5/1993 | Murray et al. | 123/44 B |
| 6,928,965 | B2 * | 8/2005 | Teufl | 123/43 R |

* cited by examiner

*Primary Examiner* — Mary A Davis
(74) *Attorney, Agent, or Firm* — James E. Walton; Richard G. Eldredge

(57) ABSTRACT

The rotary reciprocating piston engine as a rotor rotatably journaled in a housing and a plurality of pistons movable in radial direction in the rotor between outer and inner dead points. Each piston has a piston rod mounted on a transverse shaft carrying at each end a sliding element which is displaceable in radial grooves formed in the rotor on both sides of the piston. The sliding elements are each provided on the outer side thereof facing away from the piston with a pin received in a housing-fixed star-shaped endless guide groove. The guide groove extends about the axis of rotation of the rotor and controls the movement of the pistons in radial direction between the inner and outer deadpoints.

36 Claims, 10 Drawing Sheets

SECTION A-A'

SECTION A-A'

SECTION C-C'

SECTION B-B'

FIGURE 7
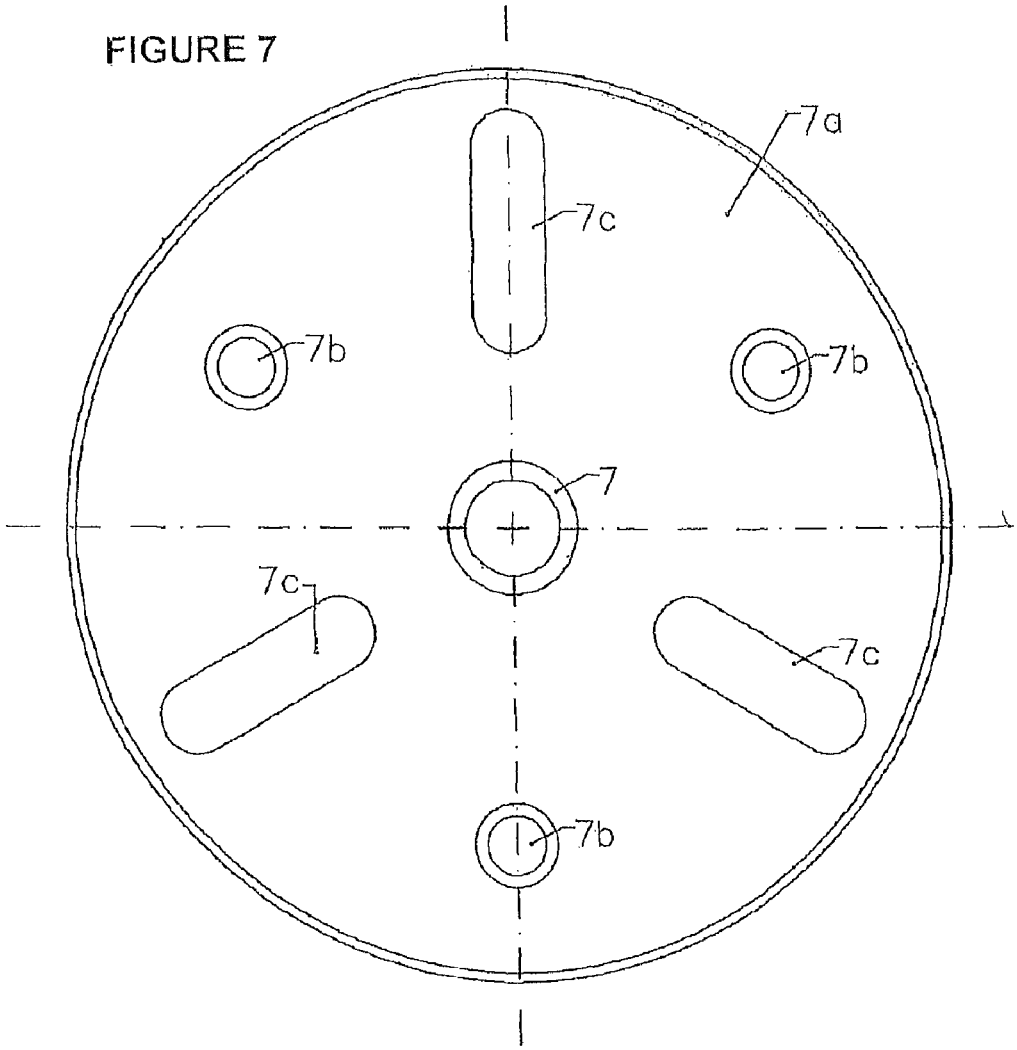
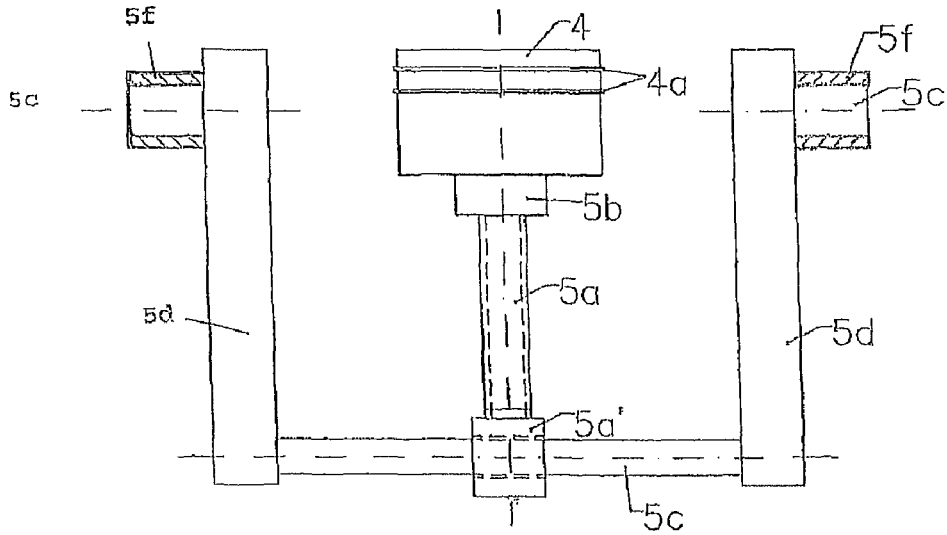
FIGURE 8

ROTARY PISTON ENGINE

The invention concerns a reciprocating piston machine, and especially a rotary reciprocating piston machine, which can be operated both as prime mover as well as an internal combustion engine, especially a four stroke internal combustion engine.

In conventional reciprocating piston machines force is usually transmitted by means of swinging articulated type connecting rods interconnecting the pistons and a crank shaft. In the cylinder head outlet and inlet valves are provided which are actuated through one or more cam shafts from the crank shaft. The conventional reciprocating piston machine has relatively large dimensions and is assembled from a large number of different machine elements. Conventional machines are extremely difficult to be reliably operated for extended time periods with biological fuels as such fuels always have certain contents of foreign materials which are difficult to be filtered out and contaminate or cause soiling of motor parts. Particularly the inlet and outlet valves are concerned, as well as everything operating in conjunction with the valves, such as the valve actuating structure. The machine parts concerned paste or stick together after short periods of operation and can no longer be properly actuated, thus requiring cleaning of the engine. The object of the invention is to provide a reciprocating piston machine having a compact, simple and light weight construction with relatively few machine elements and requiring no inlet and outlet valves.

According to a first solution of this object the invention provides a reciprocating piston machine according to the independent claim 1.

By elimination of the conventional cylinder head, the swinging articulated connecting rods, the crank shaft, the cam shaft or shafts as well as the inlet and outlet valves with the actuating mechanisms thereof, a smaller construction volume, as well as a reduction of material, weight and required space is achieved. As inlet and outlet valves are no longer required the reciprocating piston machine, in the motor application, can also be operated for a longer period of time with biological fuels until cleaning and maintenance work must be carried out.

Due to the low number of elements of constructions, only about sixty machine parts are needed, which represents a reduction of more than 50%, the production cost is also reduced. Moreover, the construction of the rotary piston machine of the invention allows for an easy assembly and simplified maintenance. As no valves with the associated valve actuating means are required, the operating noise is also reduced. In view of lesser friction losses an efficiency increase of about 60% is achievable. As no swinging articulated connection rods are required for the force transmission no transverse forces are applied to the pistons thereby reducing wear of the pistons to a minimum and permitting operation with reduced height and accordingly lighter weight pistons. The housing-fixed guide tracks may be configured, so that in case of an internal combustion engine the piston effects for each revolution of the motor one or a plurality, preferably two working cycle, which (compared to the conventional four-stroke engine) represents a duplication (in case of one working cycle) or a quadruplication (in case of two working cycles). Thus, the motor can be operated at reduced speed and also the duration of the elements of construction is increased. In the application as a pump or compressor the guide tracks can be configured in order to provide one, two, three, four or more working cycles par revolution.

A plurality of pistons can be arranged equidistantly about the axis of rotation of the piston machine in order to reduce motor vibrations. Due to the simple circular shape of the rotor sealing problems, such as encountered in Wankel engines, are generally excluded.

The higher efficiency ensures a reduced fuel consumption and reduces exhaust gases. With a few constructional modifications any commercially available fuels can be used. By extension of the combustion path a reduced NOX generation is achieved. The engine can possibly be operated without catalyzer and is especially appropriate for force-heat coupling (generator application).

According to a preferred embodiment the rotor has a cylindrical rotor body provided with a plurality of radial bores equally spaced from one another in circumferential direction and whose central axes are located in a common plane which is normal to the axis of rotation of the rotor. The bores extend from the circular circumferential surface of the rotor inwardly and cylinder bushings are floatingly mounted in the bores, with the pistons being movable in radial direction inwardly and outwardly within the cylinder bushings. The floatingly arranged cylinder bushings are urged by centrifugal force and possibly also assisted by a spring means radially outwardly in contact with the circular inner housing wall in order to tightly close the cylinder chambers with respect to the housing inner wall.

Preferably the guide means of the sliding elements consist of axial pins, which are provided with a slide bushing of bearing metal or with antifriction bearings, preferably needle bearings, to reduce frictional resistance. On both sides of the rotor drive or driven shafts are flanged on, which are rotatably mounted in the housing. These shafts are preferably hollow and are in fluid communication with a central hollow space of the rotor, for the circulation of a coolant or lubricant, preferably oil, which is ducted to an oil cooler upon discharge from the reciprocating piston machine and after cooling is introduced into the machine. The housing of the reciprocating piston machine may be air or water cooled.

The sliding elements may be guided in radial grooves of the rotor body and/or in radial slots of flanges of the drive or driven shafts fixed to the side surfaces of the rotor body.

According to a second solution of the object of the invention, the invention provides a reciprocating piston engine according to the independent claim 11. In this solution of the object of the invention the sliding elements are not needed as the transverse shaft itself is guided by the guide tracks. The construction is then even simpler and the frictional losses of the sliding elements movable in the guide grooves and/or flange slots is eliminated. The piston rod can be guided with low frictional resistance in a slide bearing bushing or a ball or needle bushing seated in a radial bore of the main rotor body about the piston rod.

The housing has inlet and outlet openings. In the application as an internal combustion engine fuel injecting means and water or vapor injection means may also be provided.

In the dependent claims other preferred features of the rotary reciprocating piston machine are defined.

The rotary reciprocating piston machine will now be described in greater detail with reference to the accompanying drawings, wherein:

FIG. 7 is an end view of a drive or driven shaft with attachment flange;

FIG. 8 shows the piston assembly comprising the piston, piston rod, transverse shaft and sliding elements;

Figure 1:
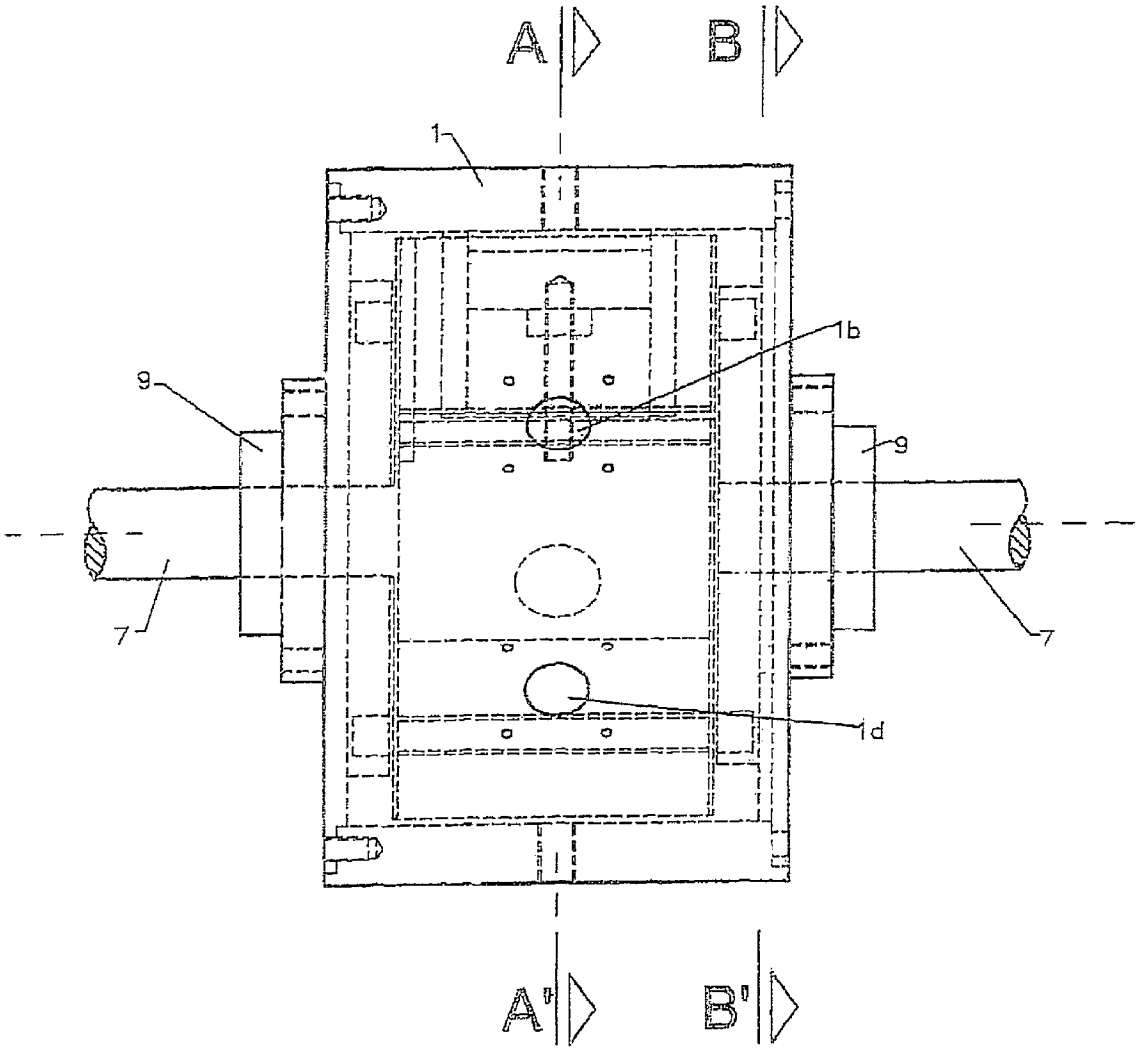
FIG. 1 is a side view of the rotary reciprocating piston machine according to the invention.
Figure 2:
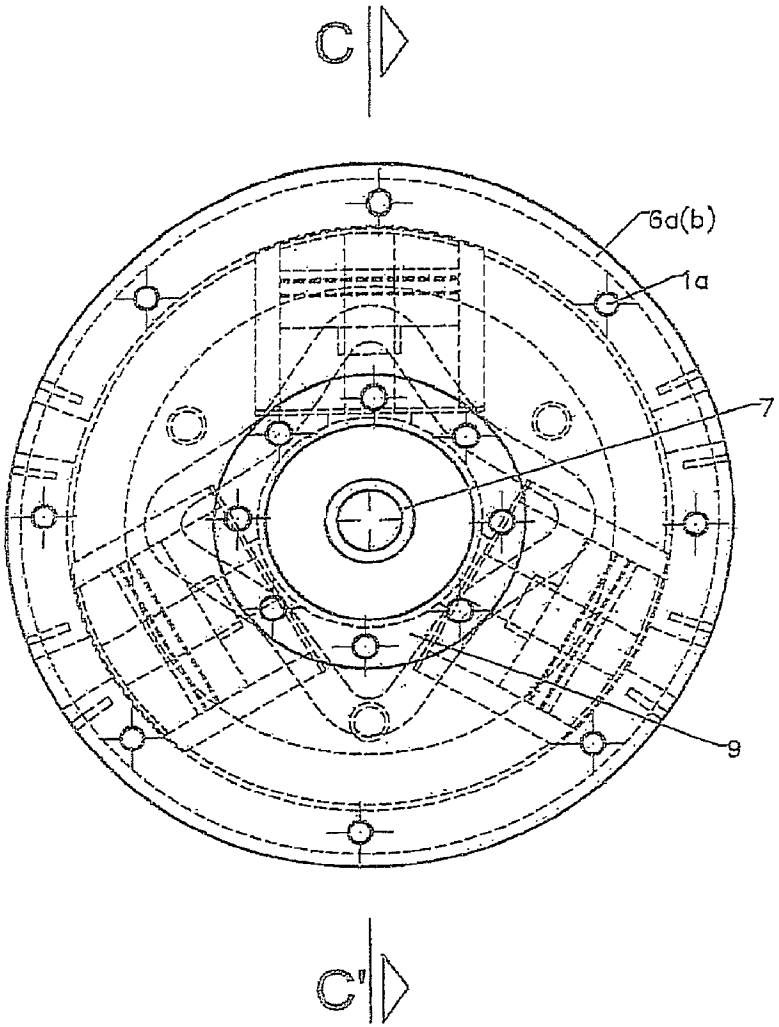
FIG. 2 is an end view of the rotary reciprocating piston machine according to FIG. 1.

The application of the rotary reciprocating piston machine as a motor or an internal combustion engine will now be described. However, as pointed out previously, the rotary reciprocating piston machine according to the invention can also be operated as a pump or a compressor.

Further, the rotary reciprocating piston engine will be described hereinafter with reference to an embodiment provided with three pistons, but the engine may also be a one or two piston engine or may be provided with four or more than four pistons.

Further, the rotary reciprocating piston machine will be described hereinafter in combination with star-shaped guide tracks for two four-stroke working cycles per piston and per rotor revolution. Other guide tracks may also be provided, as will be described later herein.

The rotary reciprocating piston engine will now be described in greater detail with reference to FIGS. 1-8. As can be seen most clearly in FIG. 4, the rotary reciprocating piston engine has a housing consisting of an outer cylindrical containment ring 1 closed at the opposite ends thereof by covers 6*a* and 6*b*. The covers 6*a* and 6*b* are fixed by threaded bolts or screws at the location 1*a* to the containment ring 1. A plurality of threaded bolts 1*a* are provided at circumferentially spaced locations. The cylindrical inner surface of the containment ring 1 is preferably honed and the containment ring 1 and the covers 6*a* and 6*b* may be fabricated from gas nitrated ST52-3. The housing is fixed to a support (not shown).

In the hollow internal space surrounded by the containment ring 1 and closed at both ends of the containment ring 1 by the covers 6*a* and 6*b* there is provided a rotor body 2 of a rotor. The rotor body 2 has an outer cylindrical circumferential surface and at its two sides a radial end surface. The rotor has furthermore on each side of the rotor body 2 a hollow shaft or hollow stub shafts 7. The shafts 7 are provided with support flanges 7*a*, which extend radially outwardly from the shafts 7 up to the outer circumference of the rotor body 2 and are fixed by threaded bolts (not shown) in threads of the rotor body 2. The shafts 7 are mounted in the housing by means of bearing arrangements. These bearing arrangements consist each at the outer side of each cover 6, 6*a* of a bearing housing 9 wherein an antifriction bearing 8 is provided for supporting the associated shaft 7. The rotor thus comprises the main rotor body 2, and the support flanges 7*a* with the shafts or stub shafts 7, which also serve as journals for the rotor.

The rotor body 2 has three radial cylinder bores 2*a*, spaced from one another at an angular spacing of ~120° degrees. The bores 2*a* extend from the outer circumferential surface of the rotor body 2 radially inwardly up to a bottom surface 2*a*'. The bores 2*a* have radial center lines L provided in a common radial plane which is normal with respect to the axis of rotation A of the rotor and all center lines L intersect at a common intersection point S located in the radial plane on the axis of rotation A.

The rotor body 2 has moreover a central, axial through passage bore 2*b*, which is in fluid communication with the hollow shafts 7.

Milled into each radial end surface of the main rotor body 2 are three radial grooves 2*c*, extending in radial direction parallel to the cylinder bore centerlines L. These grooves 2*c* extend from the central bore 2*b* of the rotor body 2 up to the outer circumferential surface of the rotor body 2. Each cylinder bore 2*a* is accordingly positioned between pairs of radial grooves 2*c* and the grooves 2*c* are parallel to the cylinder bore centerlines L. The grooves 2*c* are provided for a purpose to be described hereinafter.

Furthermore, a radial through-passage 2*d* extends from the bottom surface 2*a*' in each cylinder bore 2*a* of the rotor body 2 and communicates with the central bore 2*b*. The through-passage 2*d* has a smaller diameter than the cylinder bore 2*a* and serves for a purpose to be described later herein.

Figure 3:
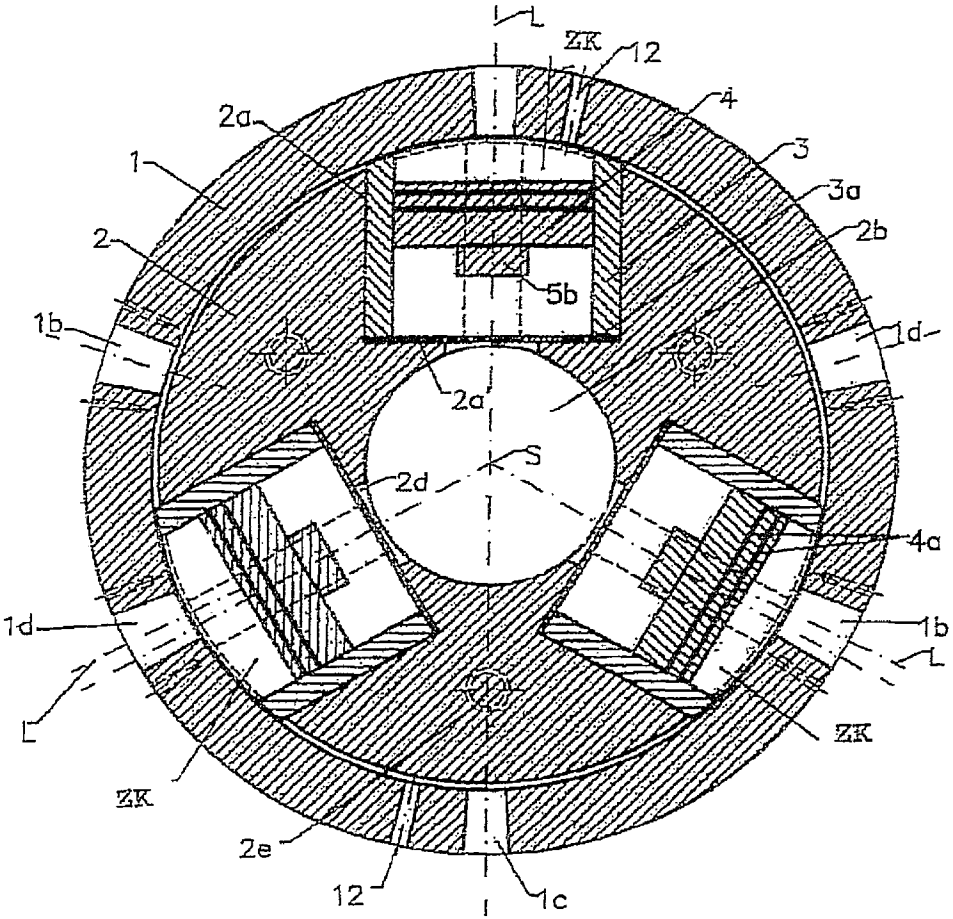
FIG. 3 is a cross-sectional view of the rotary reciprocating piston machine taken along line A-A' of FIG. 2.
Figure 4:
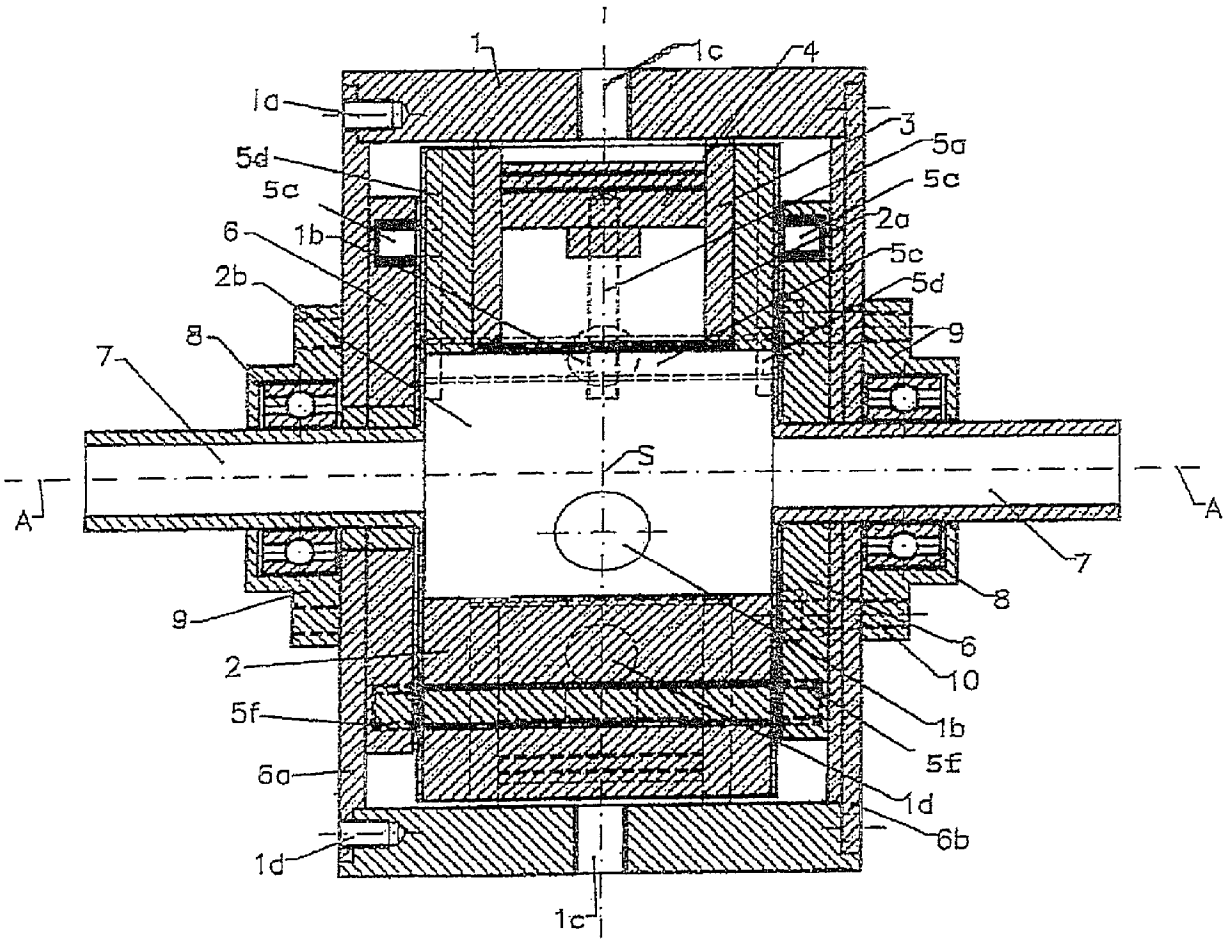
FIG. 4 is cross-sectional view of the rotary piston machine taken along line C-C' of FIG. 1.
Figure 6:
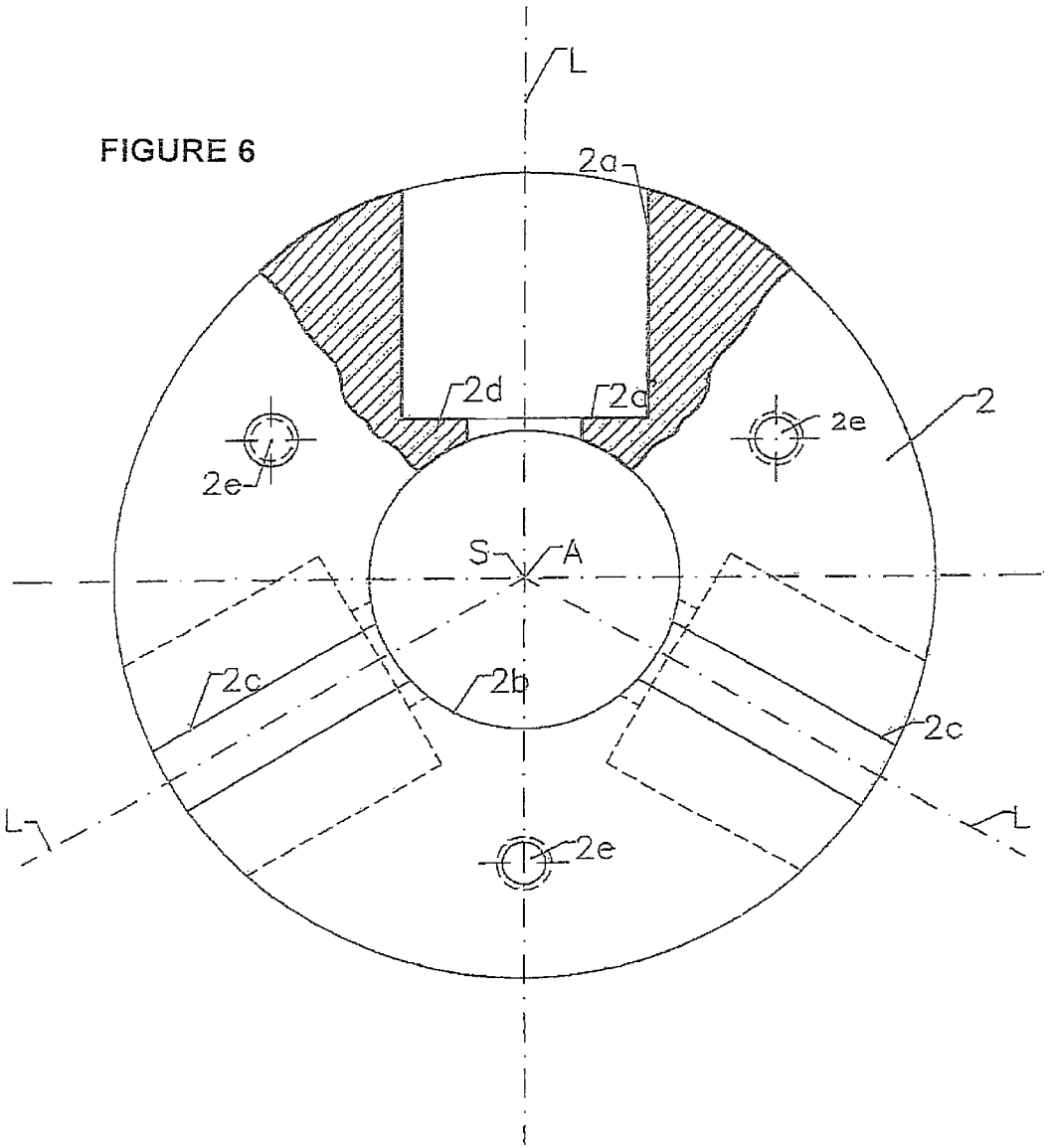
FIG. 6 is an end view, partly cut away, of the rotor body.

It remains to be mentioned that the threaded holes 2*e* shown in FIGS. 3 and 6 are provided for the threaded bolts (not shown) connecting the shaft flanges 7*a* to the rotor body 2. These bolts extend through openings 7*b* in the shaft flanges 7*a* (see FIG. 7). The rotor consists preferably of an aluminum alloy AL-CU-NI 7-13 and has a diameter preferably about 1 mm smaller than the internal diameter of the cylindrical containment ring 1.

In each cylinder bore 2*a* there is provided a cylinder bushing 3 floatingly mounted in radial direction. The radial inner end of the cylinder bushing 3 is flat and provided in a plane normal to the central line L of the associated cylinder bore 2*a*. At its radial outer end the cylinder bushing 3 is circular arc-shaped, with the radius of the circular arc corresponding to the radius of the inner surface of the containment ring 1 of the housing. The cylinder bushings 3 consist of gray cast iron casting and are provided at the radial outer ends thereof with a red bronze coating. The floatingly mounted cylinder bushings 3 are urged during rotation of the rotor 2 by centrifugal force radially outwardly in tight engagement with the inner surface of the outer containment ring 1. Spring washers 3*a* or Belleville springs may also be provided between the cylinder bushings 3 and the bottom surfaces 2*a*' of the cylinder bores 2*a* to urge the cylinder bushings 3 radially outwardly into tight engagement with the inner cylindrical surface of the outer containment ring 1.

In each cylinder bushing 3 a piston 4 is slidably arranged, provided in its circumferential outer surface with the usual piston rings 4*a* for sealing with respect to the cylinder bushing 3. The pistons 4 are movable in radial direction outwardly and inwardly in the cylinder bushings 3 and between the outer sides of the piston 4 and the inner surface of the cylindrical containment ring 1 are in closed cylinder chambers ZK are enclosed. The pistons 4 can be produced for example of commercial steel ST 52-3 or may consist of Dural. To each piston 4, at the side thereof facing away from the cylinder chamber ZK there is fixed a piston rod 5*a*. The piston rod 5*a* is fixedly threaded to the piston 4, the threaded engagement permits a fine adjustment of the piston 4 with respect to the piston rod 5*a*. A safety nut 5*b* maintains the piston 4 in the adjusted position relative to the piston rod 5*a*. If the application of the motor is known in advance, this type of adjustable attachment may be dispensed with, thus constructionally predetermining the position of the piston 4 in relation to the piston rod 5*a*. The piston rod 5*a* extends coaxially with the central line L of the associated cylinder bore 2*a* from the piston 4 radially inwardly through the radial through-passage 2*c* into the central bore or cavity 2*b* of the rotor body 2 and is provided at its inner end with a bearing eye 5*a*' wherein an axial or transverse shaft 5*c* is received, which extends parallel throughout the axial dimension or width of the rotor body 2 from one end surface thereof to the other. The transverse shaft 5*c* is provided at each end with a sliding element 5*d* extending radially outwardly from the transverse shaft 5*c*. The sliding elements 5*d* are received in the radial grooves or guides 2*c* of the rotor 2 and are radially slidable in these grooves 2*c*. Each sliding element 5*d* is provided at its outer side facing away from the piston 4 approximately at its radial outer end with a guide means or axial pin 5*e*, oriented parallel with respect to the rotor axis of rotation A. The pins 5*e* extend through radial slots 7*c* in the flanges 7*a* and are movable in a radial direction in these slots 7*c*. On each pin 5*e* there is provided a bearing bushing 5*f* consisting of bearing metal, or preferably an anti-friction bearing, such as for example a needle bearing.

At the radial inner surface of each housing cover 6*a*, 6*b* there is fixed a guide track disc 6 located between the associated cover 6*a* or 6*b* and the flange 7*a* of the associated shaft 7. The guide track discs 6 are fixed to the covers 6*a*, 6*b*, by means of threaded bolts 10 extending through through-holes formed in the discs 6 as well as through-holes aligned therewith formed in the covers 6*a* and 6*b* and threadably engaged in threaded holes of the bearing housings 9.

Figure 5:
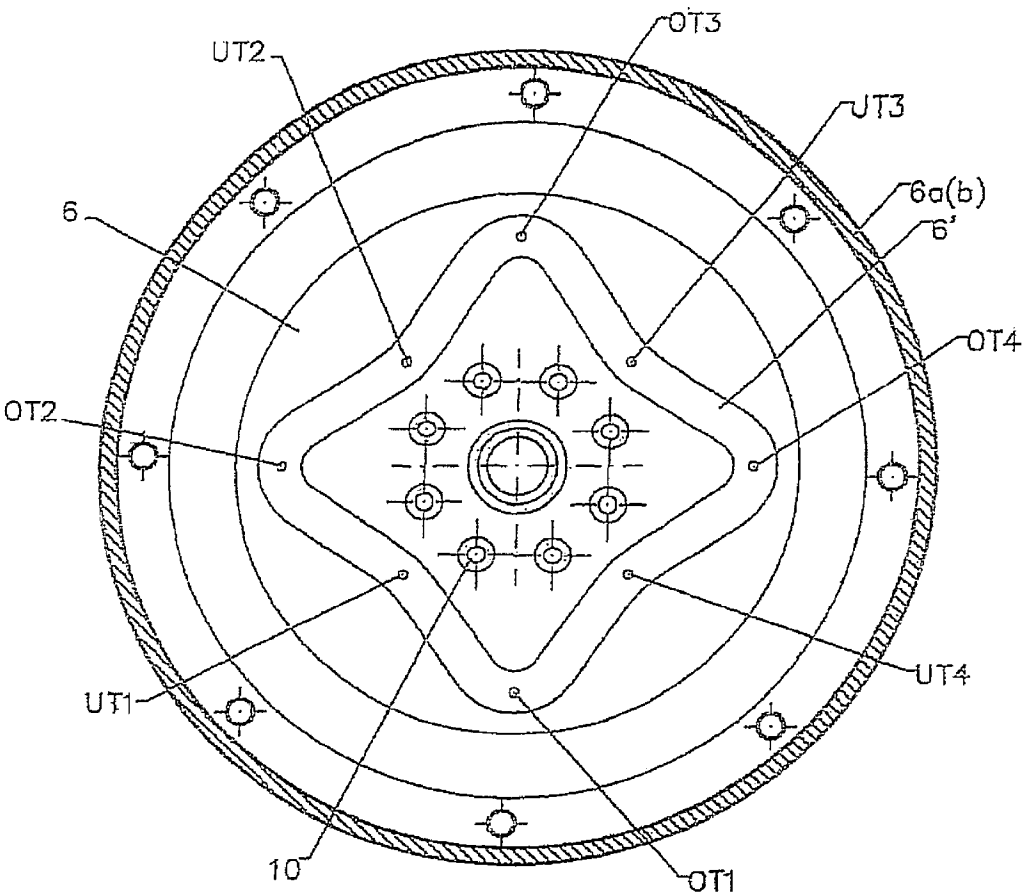
FIG. 5 is a cross-sectional view taken along line B-B' of FIG. 1.

Each track disc 6 is provided on its inner side facing the rotor body 2 with a star-shaped guide track or guide groove 6', see particularly FIG. 5, in which the pins 5*e* of the sliding elements 5*d* are received and move in rotational direction when the rotor 2 rotates. The slide or anti-friction bearings mounted on the pins se reduce the frictional losses between the pins 5*e* and the guide grooves 6'.

The guide tracks or guide grooves 6' may also be milled directly in covers 6*a*, 6*b*. The guide track discs are then not necessary. The guide tracks are stationary or fixed with respect to the housing, i.e. housing-fixed, as the covers 6*a*, 6*b* are non-rotatable housing parts.

Also the bearing housings 9 of the hollow shafts 7 may be constructionally integrated, so that elements 6, 6*a* and 9 and elements 6, 6*b* and 9, respectively, each consist of one single part.

As can be seen most clearly from FIG. 5, each star-shaped guide groove 6' has four track crests spaced 90° degrees from one another, defining upper dead points of the piston 4 as well as four track valleys located in circumferential direction centrally between the track crests and defining lower dead points for the piston 4. In the FIG. 5 the upper dead points are designated OT1, OT2, OT3 and OT4 and the lower dead points are designated UT1, UT2, UT3 and UT4. During rotation of the rotor in clockwise direction the pistons 4 are therefore moved by the follower pins 5*e*, the sliding elements 5*d*, the transverse shaft 5*c* and the piston rod 5*a* alternatively inwardly and outwardly for carrying out the stroke movements. For the clockwise direction of rotation, and starting from the upper dead point OT1, an associated piston 4 will first be displaced radially inwardly until the lower dead point UT1 is reached, then again outwardly up to the upper dead point OT2 and then again radially inwardly up to the lower dead point UT2, etc.

The outer containment ring 1 of the engine housing has radial inlet openings 1*d*, note FIG. 3, for combustion air or for an air-fuel mixture, radial outlet openings 1*b* for the combustion products as well as threaded bores 1*c* for spark plugs (not shown), and connections 12, if desired, for water injection into the cylinder chambers ZK after ignition and passage of the pistons through the associated upper dead points.

If for example the compressed air-fuel mixture is ignited at the upper dead point OT1 by a spark plug threaded into the threaded bore 1*c*, there occurs a expansion stroke when the pin 5*e* proceeds in the guide groove 6' from the upper dead point OT1 to the lower dead point UT2, thereafter the exhaust stroke from UT1 to OT2 for expelling the combustion products through the outlet opening 1*d*. When OT2 is reached an associated piston 4 is again moved radially inwardly by means of the guide track groove 6' and the corresponding cylinder bore ZK is placed in communication with the inlet opening 1*b*. Accordingly fresh air or a new air-fuel mixture is sucked in. On reaching UT2 the intake stroke is completed and the compression stroke begins and lasts until OT3 is reached, located diametrically opposite OT1. At OT3 there occurs a new ignition by means of the spark plug threaded into the threaded bore 1*c* and a new working cycle starts from OT3 over UT3 up to OT4 and over UT4 back to OTT. It can thus be seen that for each rotor revolution two working cycles are carried out. Instead of the intake of an air-fuel mixture fuel can also be injected directly into the cylinder chambers ZK or combustion spaces, by means of injection means not shown in the figures.

The force transmission from the pistons 4 to the output shafts 7 or in opposite direction is effected by the cooperation of the pins 5*e* with the star-shaped guide grooves 6' as well as by the cooperation of the sliding elements 5*d* with the radial guide grooves 2*c* of the rotor 2. By the pressure of the combustion gases after ignition at the upper dead points OT1 and OT3, the pins 5*e* are moved inwardly in the stationary, star-shaped guide grooves 6*d* and therefore drive the rotor 2 in circumferential direction by means of the sliding elements 5*d*. The pistons 4 spaced 120° degrees in circumferential direction from one another therefore apply successively a drive pulse to the output shafts 7. By the rotating rotor the pistons 4 are again moved outwardly after the expansion stroke by means of the cooperation of the pins 5*e* with the guide grooves 6*a* to expel the combustion gases and thereafter moved inwardly for the ingestion of new charge in an intake stroke and are then moved again outwardly to compress the ingested new charge until a new ignition occurs. The internal combustion engine with rotary reciprocating pistons operates thus according to the usual four stroke process or cycle.

For the application as a power engine, namely as pump or compressor, the threaded openings 1*c* for the spark plugs are not required. However, the number of the inlet openings and outlet openings must be duplicated as in this case there will be four working cycles, namely four intake and compression strokes, during each rotor revolution.

The invention is not limited to the herein disclosed embodiment, to the contrary, several modifications and variations can be provided by one skilled in the art without departure from the scope of the annexed claims.

Figure 9:
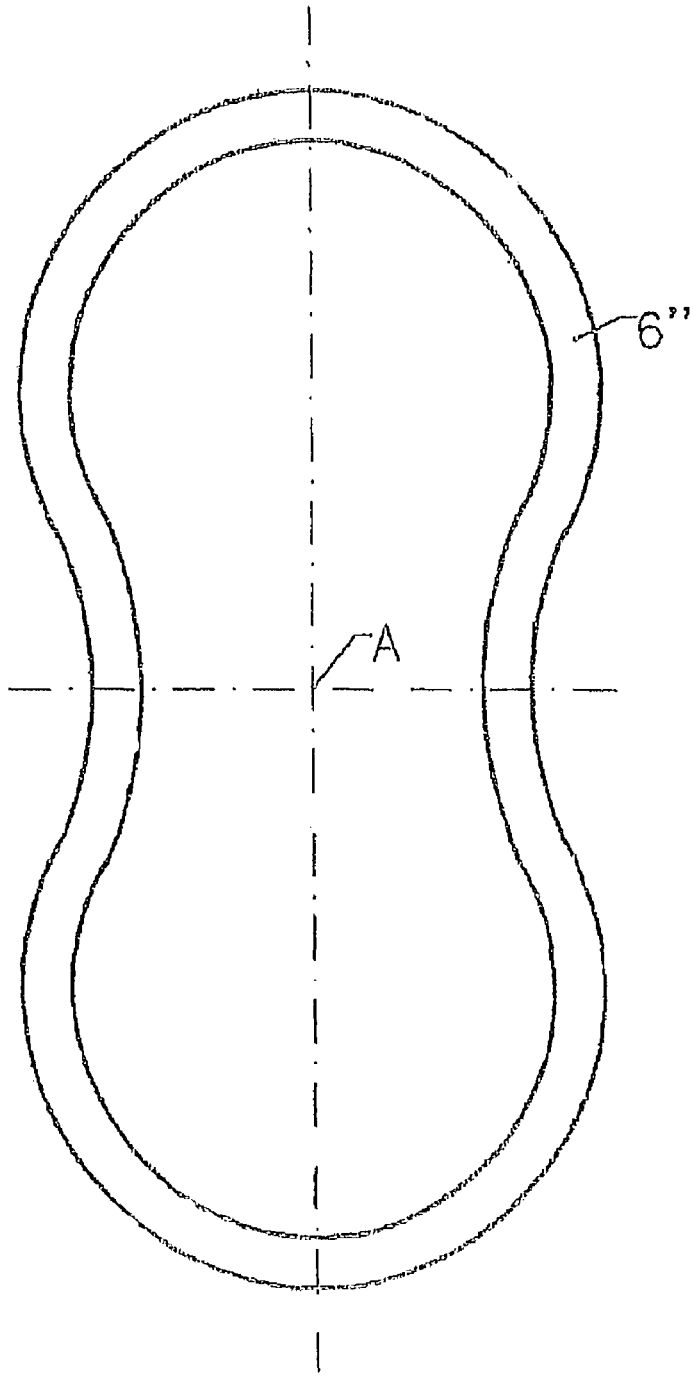
FIG. 9 shows a modified cam track for the application as an internal combustion engine.

Instead of a four-armed, star-shaped guide track 6' it would be possible to provide for example a guide track 6" in form of an elongated, for example generally kidney-shaped or 8-shaped, loop as shown in FIG. 9. There would, however, be only one working cycle par revolution of the rotor. For larger motors it would also be possible to provide more than four working cycles par revolution.

Figure 10:
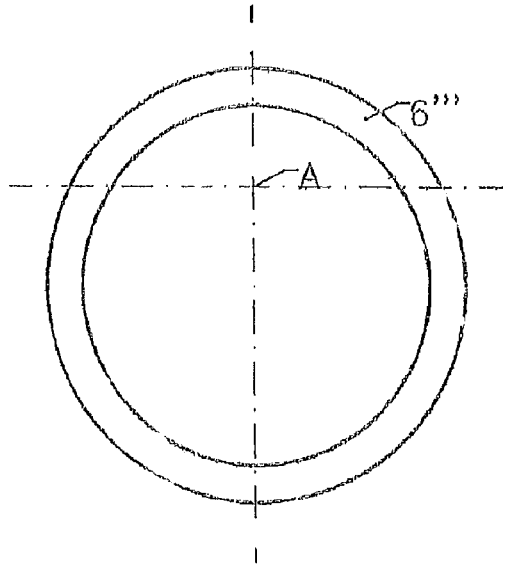
FIGS. 10 and 11 show other modified cam tracks for the application as a power engine.
Figure 11:
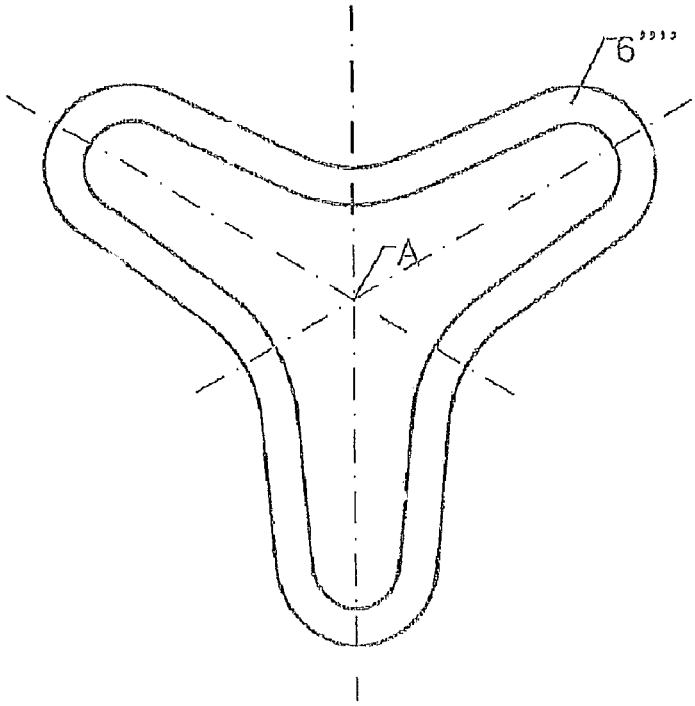

For the application as a power engine, such as for example a pump for liquid mediums or a compressor for gaseous mediums, other different guide tracks can be provided, as shown in the FIGS. 10 and 11. The guide track 6'" according to FIG. 10 is generally circular and eccentrical with respect to the axis of rotation A of the rotor. With the guide track 6' according to FIG. 10 the piston effects one working cycle par revolution, namely one intake stroke and one compression or pump stroke. Instead of the circular form the cam track 6'" according to FIG. 10 could also be oval, elliptical or egg-shaped.

The FIG. 11 shows a star-shaped guide track 6"" having three arms for three working cycles per rotor revolution about the axis A of the pump or compressor rotor. The guide track 6" according to FIG. 9 can also be used in the application as pump or compressor for two working cycles par revolution.

As previously described there may be provided two or only one single drive or driven shafts 7. The sliding elements 5*d* in addition to be guided in the grooves 2*c* of the motor body 2 can also be guided in the radial slots 7*c* of the flanges 7*a*. If the flanges 7*c* have a sufficient thickness the guiding element 5*d* can be guided only in the slots 7*c* of the flanges 7*a* and the grooves 2*c* in the rotor body 2 could be eliminated.

The through-bore 2*b* of the rotor body 2 may also have a smaller diameter and can be provided for each cylinder bore 2*a* with an axial through-slot (not shown), which enlarges the rotor bore 2*b* radially outwardly and intersects the cylinder bore 2*a*. In this case the piston rod 5*a* would extend into the axial through-slot and the transverse shaft 5*c* would be arranged in the through-slot and movable radially inwardly and outwardly therein.

The flanges 7*a* may partly or completely cover the side faces of the main rotor body 2. In an embodiment with partial coverage the radial slots in the flange would extend up to the outer circumference thereof. In an embodiment with full coverage these radial slots 7*d* would be formed as elongated holes, which do not extend up the outer circumference of the flange, note FIG. 7.

It is also possible to provide the guide means on the inner sides of the sliding elements 5*d*, but then the sliding elements 5*d* must extend radially beyond the rotor and the guide tracks would be provided in radial surfaces of the outer containment ring of the housing.

Figure 12:
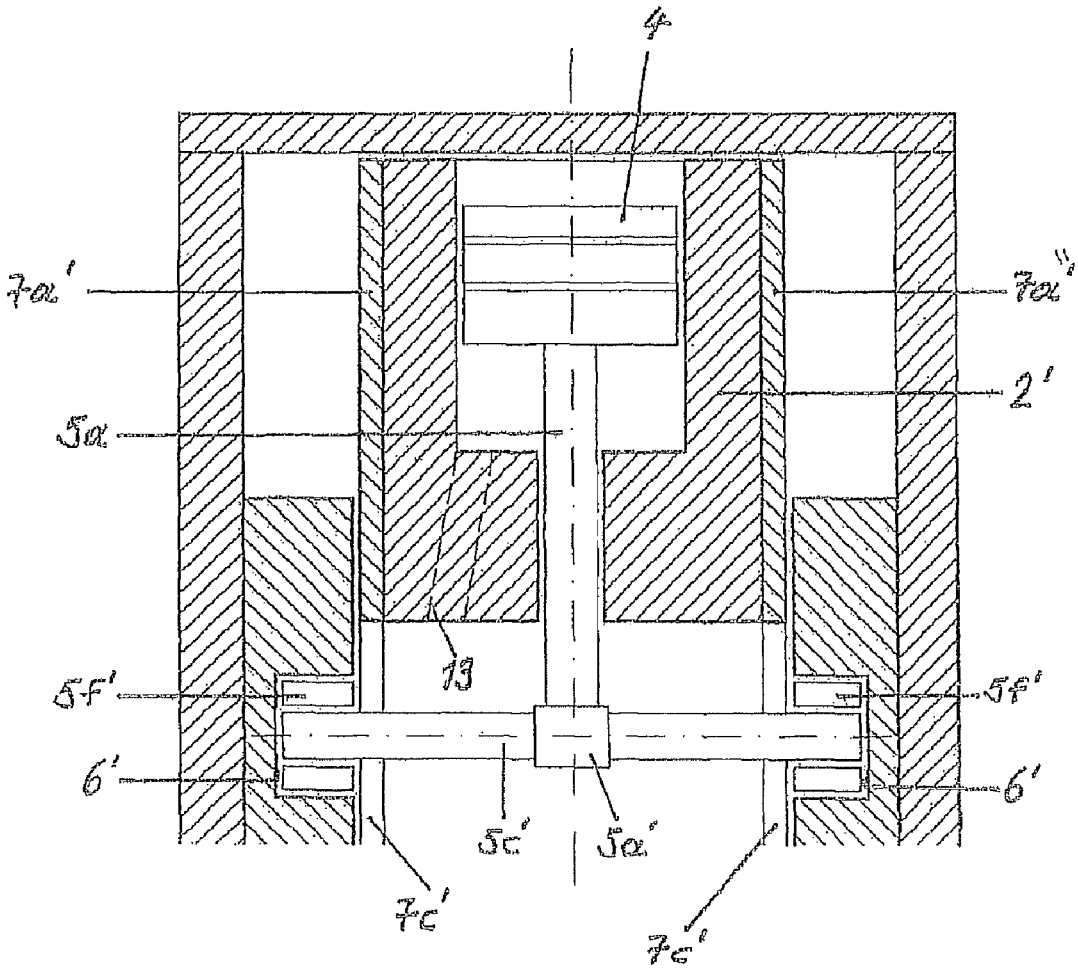
FIG. 12 shows another embodiment of the rotary reciprocating piston machine.

A simplified embodiment of the invention is shown in FIG. 12. In this embodiment the axial transverse shaft 5*c* extends through radial slots 7*c*' in the support flanges 7*a*' and engages at its ends the guide tracks 6'. The slide, elements 5*d* are not provided. On the ends of the transverse shaft 5*c*' there are mounted slide sleeves 5*f*' of bearing metal or antifriction bearings, such as needle bearings for reducing the friction of the transverse shaft 5*c*' in the guide tracks 6'. Instead of the guiding by the sliding elements 5*d* the piston shaft 5*a* is guided in this embodiment in radial direction in the main rotor body 2'. There may also be mounted a slide bearing bushing or a ball or needle bushing (not shown) in the rotor body 2' for guiding the piston shaft 5*a* with reduced frictional resistance in the rotor body 2'. The cylinder bore below the piston 4 is in this embodiment in fluid communication through one or more separate holes 13 (only one schematically shown) with a substantially pressure-less internal cavity of the rotor or of the housing, so that no back pressure can be generated below the piston 4. As in the embodiment according to FIGS. 1-11 the transverse shaft 5*c*, is received in a central axial cavity or in axial slots of the rotor body 2'. The cylinder bushing 3 is not shown in FIG. 12, but may also be provided. The guide tracks 6' are formed as described with respect to the first embodiment.

In view of the elimination of the radial sliding elements 5*d* the piston 4 is now provided further radially outwardly with respect to the guide tracks, having substantially the same dimensions as in the first embodiment and therefore the outer diameter of the rotor is increased. However, to compensate this at least partly, the transverse shaft 5*c*' may be radially outwardly offset at both rotor sides, namely the ends of the transverse shaft 5*c*', provided with the bearing means guided in the guide tracks, could be displaced radially outwardly in relation to the bearing location of the transverse shaft 5*c*' in the bearing eye 5*a*' of the piston rod 5*a*. This offset would thus at least partly replace the guiding elements.

The invention claimed is:

1. Reciprocating piston machine comprising:

a stationary housing;

a rotor rotatably disposed within the stationary housing, the rotor having:

a cylinder bore;

a first guide groove and a second guide groove, both the first guide groove and the second guide groove extending alongside the cylinder bore;

a hollow interior in fluid communication with a hollow shaft;

a through passage configured to provide fluid communication between the cylinder bore and the hollow interior;

a piston received within the cylinder bore and movable in the radial direction with respect to a machine axis;

wherein both the first guide groove and the second guide groove extend relatively parallel to the stroking motion of the piston;

a working chamber enclosed in the cylinder bore on a first side of the piston;

an inlet opening and an outlet opening extending through the stationary housing and configured to alternatively communicate with the working chamber during rotor rotation;

a linkage having:

a radial piston rod adjustably attached to a second opposing side of the piston at a first end and rotatably coupled to an opposing second end to an axial transverse shaft, the axial transverse shaft extending in a direction relatively perpendicular to the radial piston rod;

wherein the radial piston rod extends through the through passage and the transverse shaft remains disposed within the hollow interior of the rotor;

a first elongated sliding element attached to a first end of the axial transverse shaft and a second elongated sliding element attached to a second opposing end of the axial transverse shaft, both the first elongated sliding element and the second elongated sliding element extending in the radial direction relative to the cylinder bore;

wherein the first elongated sliding element is slidably received within the first guide groove and the second elongated sliding element is slidably received with the second guide groove;

wherein both the first elongated sliding element and the second elongated sliding element move in a direction relatively parallel to the stroking motion of the piston;

a first axial pin attached to the first elongated sliding element and a second axial pin attached to the second elongated sliding element;

wherein both the first axial pin and the second axial pin are guided on both sides of the piston by endless guide tracks extending about the machine axis and having in circumferential direction a variable distance from the machine axis, said guide tracks controlling through the linkage a radial stroking motion of the piston between inner and outer dead points, wherein the cylinder bore and the piston are provided in the rotor mounted in the housing for rotation about the machine axis and the endless guide tracks are stationary guide tracks fixed relative to the housing, and that the linkage with the rotor and the piston are rotatable about the machine axis and the linkage is movably guided on the rotor with respect thereto in the direction of the stroking motion of the piston.

2. Reciprocating piston machine according to claim 1, wherein the transverse shaft is guided at its ends by the guide tracks and the piston rod is guided between its ends in the rotor in radial direction and coaxially with respect to the piston stroking motion.

3. Reciprocating piston machine according claim 2, wherein the rotor has a rotor body provided with support flanges by means of which the rotor is supported and journaled in the housing, and wherein the transverse shaft extends through radial slots in the support flanges and is movable therein in radial direction.

4. Reciprocating piston machine according to claim 2, wherein the transverse shaft is provided with bearings for low friction guidance of the transverse shaft in the guide tracks.

5. Reciprocating piston machine according to claim 2, wherein the piston rod is guided with low frictional resistance in a bearing bushing provided in the rotor body.

6. Reciprocating piston machine according to claim 2, wherein the cylinder bore radially inwardly of the piston is in fluid communication with the housing interior by at least one hole in the rotor body.

7. Reciprocating piston machine according to claim 2, wherein the ends of the transverse shaft, guided by the guide tracks, are radially outwardly offset from the mounting location of the piston rod on the transverse shaft.

8. Reciprocating piston machine according to claim 1, wherein the piston rod is guided between the ends thereof in radial direction in the rotor coaxially to the piston stroking motion.

9. Reciprocating piston machine according to claim 1, wherein both the first axial pin and the second axial pin are provided at the sides of the sliding elements facing away from the piston.

10. Reciprocating piston machine according to claim 1, wherein the rotor has a central axial through bore communicating by means of a radial passage with the interior of the radial cylinder bore of the rotor and wherein the piston rod connecting the piston with the transverse shaft extends through the radial passage and the transverse shaft is movable in the through bore in radial direction inwardly and outwardly.

11. Reciprocating piston machine according to claim 1, wherein the rotor has a central axial through bore which is enlarged radially outwardly by at least one axial through slot, wherein the slot extends upwardly to intersect the radial cylinder bore of the rotor and the piston rod connecting the piston with the transverse shaft extending into the slot, and the transverse shaft is movable in the slot in radial direction with respect to the rotor body.

12. Reciprocating piston machine according to claim 1, wherein the rotor has a rotor body provided with support flanges for supporting and journaling the rotor in the housing, said flanges being further provided with radial slots aligned in radial direction with the sliding elements, and wherein the sliding elements are guided in the flange slots and/or in guide grooves of the rotor body.

13. Reciprocating piston machine according to claim 1, wherein the rotor has a cylindrical rotor body provided with a cylindrical circumferential surface and having end surfaces normal to the machine axis of rotation on both sides of the cylindrical rotor body and wherein the support flanges are fixed to the end surfaces for supporting and journaling the rotor body in the housing.

14. Reciprocating piston machine according to claim 1, wherein the rotor has a plurality of cylinder bores, there being provided one piston in each cylinder bore, and wherein the pistons are movable along radial axes, all of which being located in a common radial plane normal to the rotor axis of rotation.

15. Reciprocating piston machine according to claim 14, wherein the pistons are equally spaced from one another in circumferential direction of the rotor.

16. Reciprocating piston machine according to claim 1, wherein the cylinder bore opens at its radial outer end at the outer circumferential of the rotor and is sealed with respect to an inner circumferential surface of a housing envelope snugly surrounding the rotor, and wherein the inlet and outlet openings are provided in the housing envelope.

17. Reciprocating piston machine according to claim 16, wherein the cylinder has a cylinder bushing inserted in the rotor body.

18. Reciprocating piston machine according to claim 17, wherein the cylinder bushing is mounted in the rotor to be freely floating in radial direction and has at its radial outer end a circular arc surface having a radius corresponding to the radius of an inner circumferential housing surface surrounding the rotor, and wherein during machine operation the cylinder bushing is maintained by centrifugal force in engagement with the inner circumferential housing surface.

19. Reciprocating piston machine according to claim 17, wherein the cylinder bushing has a red bronze coating at the end thereof facing the housing.

20. Reciprocating piston machine according to claim 17, wherein a spring washer is arranged below the cylinder bushing to urge the cylinder bushing radially outwardly against the housing internal surface.

21. Reciprocating piston machine according to claim 1, wherein the piston is adjustably fixed to the piston rod by means of a threaded connection including a safety nut.

22. Reciprocating piston machine according to claim 1, wherein the housing is provided on both sides of the rotor with a cover, the rotor being enclosed in the housing between the covers.

23. Reciprocating piston machine according to claim 22, wherein the covers are provided with track grooves forming the guide tracks.

24. Reciprocating piston machine according to claim 1, wherein the guide tracks consist of track grooves formed in track discs, with the discs being fixedly attached to the housing.

25. Reciprocating piston machine according to claim 1, wherein the hollow shaft is in fluid communication with a hollow interior of the rotor body for the supply and discharge of a lubricant and/or coolant.

26. Reciprocating piston machine according to claim 1, wherein the housing is air or water cooled.

27. Reciprocating piston machine according to claim 1, wherein the reciprocating piston machine is a pump or a compressor for liquid and gaseous mediums.

28. Reciprocating piston machine according to claim 27, wherein the guide tracks are formed so that the piston effects for each rotor revolution at least one working cycle consisting of an intake stroke and a compression stroke.

29. Reciprocating piston machine according to claim 28, wherein the guide tracks are selected between the three following alternatives:

a. a generally circular, oval, elliptical or egg-shaped guide track eccentric with respect to the machine axis and having one track crest and one track valley for one working cycle per rotor revolution;

b. an elongate, generally kidney-shaped or 8-shaped loop provided with two track crests and two track valleys for two working cycles per rotor revolution; and c. a star-shaped guide track having at least three arms and at least three track crests and three track valleys for at least three working cycles per rotor revolution.

30. Reciprocating piston machine according to claim 28, wherein the housing has for each working cycle one suction and one exhaust opening.

31. Reciprocating piston machine according to claim 1, wherein the reciprocating piston machine is a four stroke internal combustion engine.

32. Reciprocating piston machine according to claim 31, wherein the guide tracks are formed so that the piston effects for each rotor revolution at least one working cycle comprising an intake stroke, a compression stroke, an expansion stroke and a discharge stroke.

33. Reciprocating piston machine according to claim 32, wherein the form of the guide tracks is selected between the following two alternatives:

a. an elongate, generally kidney-shaped or 8-shaped loop having two track crests and two track valleys for one working cycle par rotor revolution; and b. a star-shaped guide track with at least four arms and at least four track crests as well as at least four track valleys for at least two working cycles per revolution.

34. Reciprocating piston machine according to claim 32, wherein there is provided on the housing for each working cycle an inlet and outlet opening as well as a spark plug.

35. Reciprocating piston machine according to claim 32, wherein there is provided on the housing a fuel injection device for each working cycle.

36. Reciprocating piston machine according to claim 32, wherein there is provided on the housing a water injection device for each working cycle.

* * * * *